United States Patent [19]

Folk et al.

[11] 4,132,251

[45] Jan. 2, 1979

[54] APPARATUS FOR DEPLOYING TWISTED WIRES

[75] Inventors: Kenneth F. Folk; Walter C. Shatto, Jr., both of Harrisburg, Pa.

[73] Assignee: AMP Incorporated, Harrisburg, Pa.

[21] Appl. No.: 839,149

[22] Filed: Oct. 3, 1977

[51] Int. Cl.[2] ..... B21F 1/02

[52] U.S. Cl. ..... 140/147

[58] Field of Search ..... 140/147, 149; 29/747

[56] References Cited

U.S. PATENT DOCUMENTS

| | | | |
|---|---|---|---|
| 3,739,818 | 6/1973 | Tompkins | 140/149 |
| 3,779,290 | 12/1973 | Rich et al. | 140/149 |
| 3,891,013 | 6/1975 | Folk et al. | 140/147 |

*Primary Examiner*—Lowell A. Larson

*Attorney, Agent, or Firm*—Anthony S. Volpe

[57] ABSTRACT

Apparatus for deploying a plurality of twisted pairs of wires and separating the two wires of each pair comprises a templet having recesses extending thereacross in one direction. Each recess has one portion which is dimensioned to receive a single twisted pair of wires and the one portion of each recess merges with another portion comprising two separate recesses, each of which is dimensioned to receive one wire only of a twisted pair. The twisted pairs are pressed onto the recesses by a roller which moves across the surface. A controller is mounted adjacent to, and in advance of, the roller and the twisted pairs extend from beneath the roller over the controller. When the roller approaches the portions of each recess which receive only a single wire, the spacing between the roller and the controller changes so that they are separated by a distance substantially equal to the diameter of a single wire. The spacing between the roller and the controller causes the individual twisted pairs to become untwisted so that the two wires of each twisted pair are pressed into the two recesses.

10 Claims, 6 Drawing Figures

APPARATUS FOR DEPLOYING TWISTED WIRES

BACKGROUND OF THE INVENTION

This invention relates to an apparatus for deploying and locating on a templet a plurality of twisted pairs of wires and separating or untwisting portions of each pair. The embodiment of the invention described below comprises a simple bench mounted apparatus which separates or deploys the individual twisted pairs in a cable and untwists the end portion of each twisted pair. After such deployment and untwisting, the individual wires in the several twisted pairs can be subjected to further operations such as soldering to terminal posts or having terminals crimped thereon. As will be explained below, however, the principles of the invention can be used under a wide variety of circumstances, for example, in automatic cable making machines.

The conductors used for signal transmission in the telephone industry and elsewhere are usually in the form of twisted wire pairs which are often contained in a cable. When the conductors in a cable are to be connected to a junction block or to a multi-contact electrical connector, it is necessary to separate the several twisted pairs of wire from each other and untwist a portion of each pair so that the two wires of each pair can be worked on and subjected to the operation which is to be carried out. U.S. Pat. Nos. 3,853,156 and 3,884,276 discloses known apparatus for untwisting the two wires of a twisted wire pair. The apparatus shown in these patents operates on only a single twisted pair during each operating cycle and these apparatus are moreover intended for rather special uses.

The instant invention is directed to the achievement of an apparatus which can separate and deploy a plurality of twisted pairs of wires in a cable and simultaneously untwist a portion of each twisted wire pair so that the two wires of the pair will be separated from each other. The invention makes use of principles for separating and deploying wires as disclosed and claimed in U.S. Pat. No. 3,891,013 and the instant invention has the added capabilities of untwisting the wires in the twisted wire pairs.

It is accordingly an object of the invention to provide an improved apparatus for handling a plurality of twisted pairs of wires and preparing the twisted pairs for operations such as terminal crimping, wire-wrapping or soldering. A further object is to provide an apparatus for deploying and positioning a plurality of twisted pairs of wires in spaced-apart relationship and untwisting a portion of each twisted wire pair. A further object is to provide an apparatus which can be used in cable making machines to separate a plurality of twisted wire pairs and untwist a portion of each pair in preparation for installation of a multi-contact connector on the untwisted wire pairs.

These and other objects of the invention are achieved in a preferred embodiment thereof which is briefly described in the foregoing abstract, which is described in detail below, and which is shown in the accompanying drawing in which.

Figure 6:
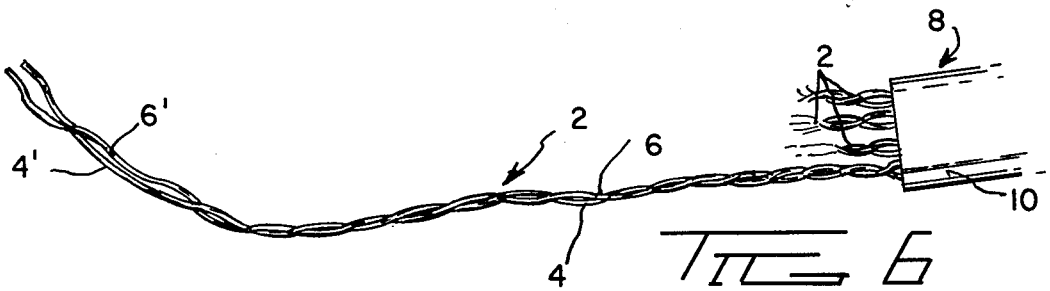
FIG. 6 is a view showing the end portion of a cable containing four twisted pairs of wires.

Referring first to FIG. 6, the disclosed embodiment of the invention serves to separate and deploy the four twisted pairs 2 of wires which are contained in a cable 8 having an outer jacket 10. Each twisted pair 2 comprises two individual wires 4, 6 which are helically twisted together along the axes, the end portion of one twisted pair being untwisted so that the wires are separated from each other as shown at 4', 6'.

Figure 1:
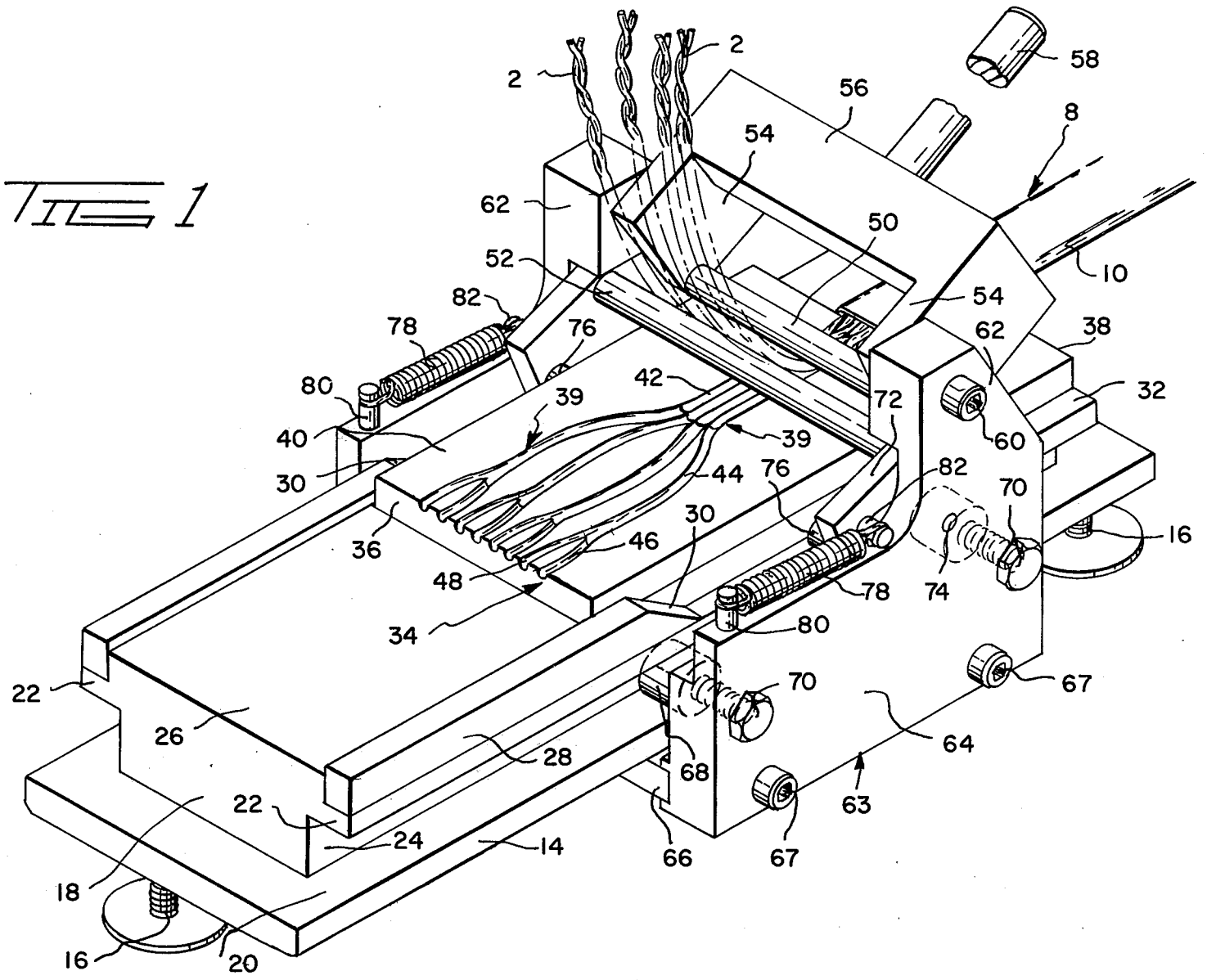
FIG. 1 is a perspective view of a preferred embodiment of the invention, this view showing the positions of the parts at the beginning of an operating cycle.

Referring now to FIG. 1, the herein disclosed embodiment of the invention 12 comprises a rectangular base plate 14 having supports 16 extending from its lower surface so that it can be supported above the surface of a work bench or the like. A generally rectangular frame block 18 is fixed to the upper surface 20 of the base plate 14 and the frame block has ribs 22 extending from its side surfaces 24 for the full length thereof. Camming bars 28 are mounted on the upwardly facing surface 32 of the ribs 22 and extend from the left hand end of the frame block to an intermediate location thereof. The ends of the ribs 28 are downwardly inclined as shown at 30 towards the surface 32 to provide camming ramps for purposes which will be explained below.

A flat rectangular templet plate 34 is mounted on the upper surface 26 of frame block 18 and has a leading end 36 which is adjacent to, and slightly beyond, the ramps 30 of the camming bars 28. The rearward end 38 of the templet plate is located at the rearward end of the frame block. The upper surface 40 of the templet plate 34 has recess means in the form of shallow grooves or channels extending therealong from the end 38 to the end 36, this recess means comprising four individual recesses, generally indicated at 39. Each recess 39 is dimensioned to receive a twisted pair of wires along most of its length and is dimensioned to receive two individual wires along a portion of its length adjacent to the end 36 of the plate. Each recess thus has a first portion 42 which extends along a straight line from the end 38 of the templet to an intermediate portion thereof, the four recesses being in side-by-side parallel relationship. Each recess has an intermediate or second portion 44 which diverges from the portion 42 so that individual twisted pairs of wires positioned in the recess will be separated and deployed on the surface 40 in spaced-apart relationship. The second portion 44 of each recess merges with a third portion comprising a pair 46, 48 of individual recesses which extend to the end 36 of the templet plate. The third portions 46, 48 of each recess means are dimensioned to receive an individual wire rather than a twisted pair and, as shown in FIG. 1, and the recesses 46, 48 merge smoothly with the second portion 44 of each recess.

The twisted pairs of wires are pressed into the recesses 39 by a pressing member in the form of a roller 50 in accordance with the teachings of the above-identified U.S. Pat. No. 3,891,013. The roller 50 is rotatably mounted between the ends of arms 54 of a yoke having a cross member 56 which spans the frame block and the upper surface 40 of the templet plate 34. A handle 58 is provided on the yoke cross member 56 to facilitate the operation of the apparatus as will be explained below. The lower ends of the arms 54 are pivotally mounted on pivot pins 60 which in turn are mounted in upwardly extending arms 62 of a slide member 63. This slide member comprises side plates 64 which are located on each side of the frame member 18 and which extend below the base plate 20. A bottom plate 66 extends beneath the base plate 14 and is secured to the side plates 64 by suitable fasteners as shown at 67. The slide plate is guided for movement between the ends of the frame plate 18 by rollers 68 which are received between the downwardly facing surfaces of the ribs 22 and the upper surface 20 of the base plate. These rollers 68 are rotatably mounted on pins 70 which extend inwardly from the side plates 64.

A controller member 52 is provided to facilitate placement of the individual twisted pairs 2 of wires in the portions 42, 44 of the recess and to untwist end portions of each twisted pair. This controller 52 comprises, in the disclosed embodiment, a cylindrical bar which is located in front of the roller 50 and which has its ends rotatably mounted in bell crank plates 72 disposed on each side of the frame block and between the frame block and the side plates 64 of the slide member 63. Each plate 72 is pivotally mounted as shown at 74 against the inside surface of its respective side plate 64 and is provided with a roller 76 at its left hand or leading end portion which bears against the upwardly facing surface 32 of the adjacent rib 22. The plates 72 are biased downwardly as viewed in the drawing by springs 78 which are secured to pins 80 in the associated side plate at one end and to pins 82 extending from their outwardly facing surfaces at their other end. This arrangement permits the plates 72 to be swung upwardly through a slight arc during operation.

Figure 3:
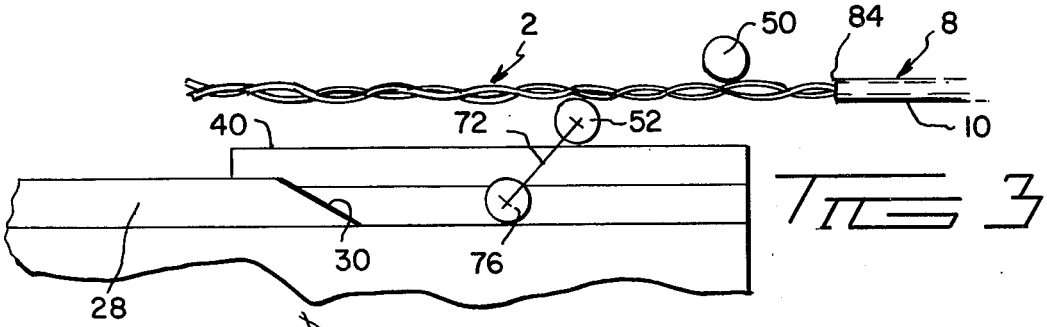
FIG. 3 is a diagrammatic side view showing the positions of the principle elements of the apparatus at the beginning of the operating cycle.
Figure 4:
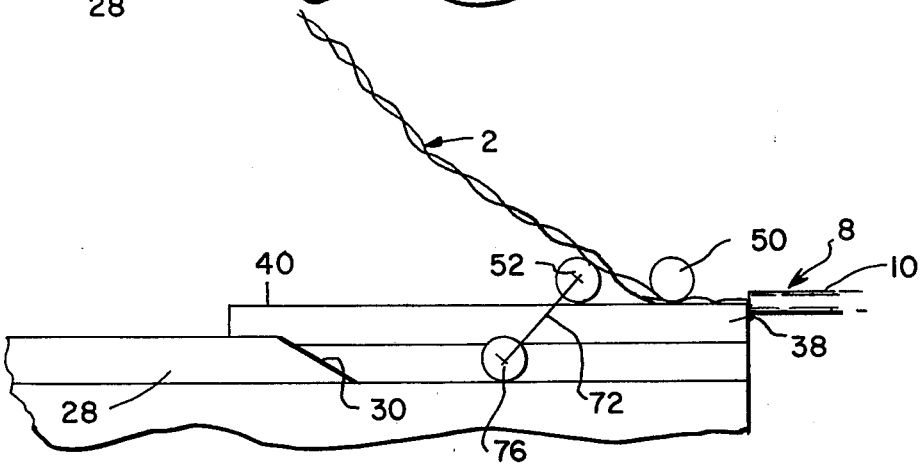
FIGS. 4 and 5 are views similar to FIG. 3 but showing the positions of the parts at successive stages of the operating cycle.

In use, when it is desired to separate the four twisted pairs 2 of the cable 8 and untwist a portion of each pair, the cable jacket 10 is cut away to expose the twisted pairs as shown in FIG. 6. The slide member is then moved to its rearward position so that it is adjacent to the end 38 of the templet plate and the yoke is swung upwardly to raise the roller 50 above the level of the surface 40 as shown in FIG. 3. The twisted pairs of wires are then threaded through the space between the roller 40 and the upper surface of the controller 52 and the edge 84 of the cable jacket 10 is located against the right hand edge of the templet plate at its end 38. The yoke is then swung downwardly towards the surface 40 of the templet plate and thereby presses the individual twisted pairs into the portions 42 of the recess means of each twisted pair adjacent to the end 38. As shown in FIG. 4, the individual twisted pairs will then extend upwardly from beneath the roller 50 and over the surface of the controller 52. The operator then moves the slide leftwardly from the position of FIG. 4 using the handle 58 to impart this leftward movement to the slide and hold the roller against the surface during such movement. During this stage of the operating cycle, the controller 52 is spaced from the roller 50 by an amount which is greater than the transverse dimension of the individual twisted pairs (the combined diameters of the two wires of each twisted pair). The controller serves the function, during this portion of the cycle, of approximately aligning each twisted pair with the portions 42, 44 of the recess into which it is to be placed. If the twisted pairs should extend laterally because of a curvature in the cable, the controller will serve to locate the portion of each twisted pair which is adjacent to the roller 50 in alignment with the roller and will prevent misplacement of the individual pairs during this rolling operation.

Figure 2:
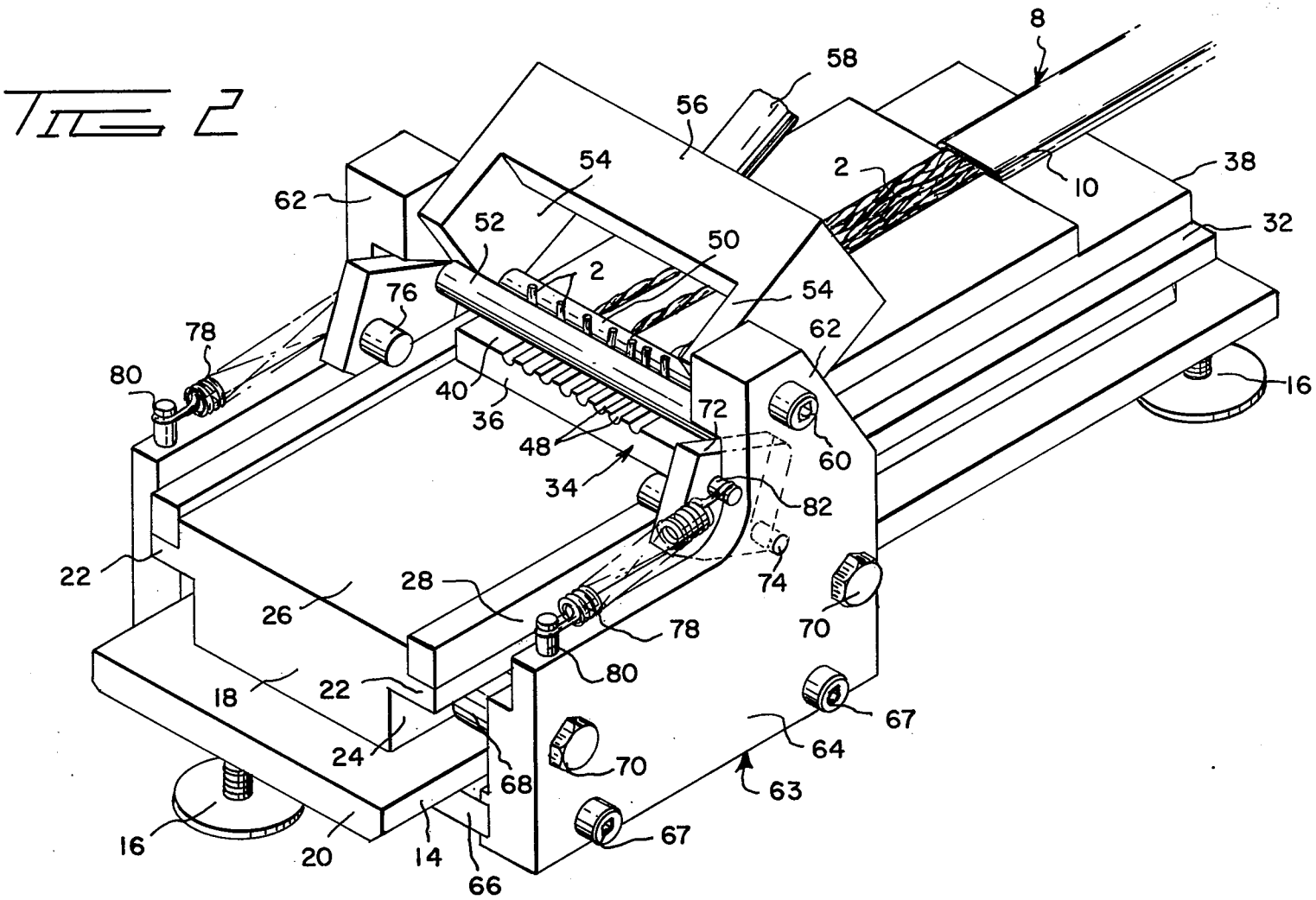
FIG. 2 is a view similar to FIG. 1 but showing the positions of the parts after the twisted pairs of wires have been deployed or separated and positioned on the templet and while the end portions of each twisted pair are being untwisted.
Figure 5:
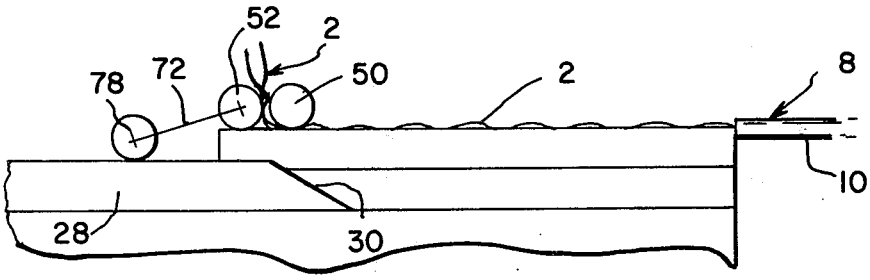

When the rollers 76 on the plates 72 move relatively upwardly on the ramps 30 as the slide is moved forwardly, the plates will be swung upwardly as viewed in the drawing but by virtue of the locations of the pivotal axis 74 of the plates, and will move relatively towards the roller 50; in other words, when the rollers 76 move up the ramp 30, the spacing between the roller 50 and the controller 52 will be reduced as shown in FIG. 5. The spacing between the roller and the controller which remains after the roller is moved to the upper surfaces of the camming bars 28 is substantially equal to the diameter of individual wires 4, 6 of the twisted pairs so that the twisted pairs can not pass between the adjacent surface of the roller and the controller as these two parts move in unison towards the end 36 of the templet plate. As a result, the end portions of the twisted pairs are untwisted from each other and are positioned in the recesses 46, 48. FIG. 2 illustrates the positions of the parts immediately before arrival of the controller at the end 36 of the templet plate and shows the two wires of each pair in side-by-side relationship. It will be apparent that the camming bars 28, the bell crank plates 72, and the rollers 76 function as a controller positioning means for changing the distance between the controller 52 and the roller 50.

The principle of untwisting the pairs can be understood if one will grasp a twisted pair adjacent to its end between his thumb and forefinger and then pull the pair axially. The confining effect on the pair requires that it untwist itself in order to permit its passage through the construction formed by the thumb and forefinger or, in the embodiment shown, between controller and the roller.

The operator can then lift the yoke member and return the slide to its starting position.

It will be apparent from the foregoing description that the controller 52 serves a dual function in the practice of the invention. During the first portion of the operating cycle and while the twisted pairs 2 of wires are being placed in the first and second portions 42, 44 of the recesses 39, the controller 52 approximately aligns each twisted pair with the recess into which it is to be placed. During the final portion of the operating cycle, the controller 52 cooperates with the roller 50 to bring about untwisting of the wires 4, 6 of each pair so that the roller will then roll the wires into the third portions 46, 48 of each recess. This dual function of the roller requires that its position relative to the roller change during the final portion of the operating cycle in that it moves relatively close to the roller as illustrated in FIG. 5. Copending Application Ser. No. 839,148 discloses and claims the wire aligning function of the controller 52 as it is used with conventional single wires rather than twisted pairs of wires.

As previously explained, the embodiment of the invention disclosed herein serves only to deploy and locate the several twisted pairs of wire and untwist the wires of each pair adjacent to their ends. The apparatus in the form shown can thus be used to prepare the ends of cables for further operations which may be carried out subsequent to deployment and untwisting. The principles of the invention can also be used in combined machines such as cable making machines which install connectors on the ends of cables. The principles of the instant invention if incorporated into a cable making machine would deploy and untwist the wires pairs as described above immediately prior to formation of the electrical connections between the wires and the terminals in the connector.

In the disclosed embodiment of the invention, the cable 8 contains only four twisted pairs of wires and these four twisted pairs are in side-by-side co-planar relationship in the cable jacket 10. The principles of the invention can be employed to deploy and untwist the twistedpairs in a cable of the type containing a greater number than four of twisted pairs with the pairs bundled in the cable jacket so that the cable has a circular cross section rather than a flat cross section. In the case of a cable containing a bundle of pairs, the bundle will be flattened when the roller 50 is moved downwardly and against the bundle (FIGS. 3 and 4) and the individual pairs in the bundle will be located in the recesses in the templet plate.

The pressing member 50 and the controller 52 may take alternative forms to these shown in the drawings. Both of these members are advantageously rotatably mounted in the slide member 63 in order to reduce friction and minimize the amount of force required to accomplish the deploying and untwisting operations. However, under some circumstances, it may proove desirable to mount these members in some other manner.

We claim:

1. Apparatus for untwisting the two wires of a twisted pair of wires and locating the untwisted wires in side-by-side co-planar relationship comprising:

a templet having a wire supporting surface extending thereacross in one direction, a recess means in said wire supporting surface, said recess means having one portion which comprises a single recess which is dimensioned to receive said twisted pair of wires and another portion comprising a pair of side-by-side recesses each of which is dimensioned to receive one wire of said twisted pair, said side-by-side recesses extending divergently from said single recess, a wire pressing member which is movable across said surface in said one direction, a wire controller disposed adjacent to said wire pressing member, said controller being in advance of said pressing member relative to the direction of movement of said pressing member across said surface, said controller providing wire deflecting surface portions which extend transversely of said wire supporting surface, actuating means for moving said pressing member and said controller across said wire supporting surface in said one direction, said actuating means having means for maintaining a first spacing between said controller and said pressing member while said pressing member is moving over said one portion of said recess means and for maintaining a second spacing between said pressing member and said controller when said pressing member is moving over said other portion of said recess means, said first spacing being greater than the transverse dimension of said twisted pair of wires, said second spacing being substantially equal to the diameter of one of said wires whereby, upon placement of said twisted pair of wires on said surface with an intermediate portion of said twisted pair in alignment with said one portion of said recess means and with said twisted pair extending over said wire controller, and upon movement of said wire pressing member and said controller, first portions of said twisted pair of wires will be pressed into said one portion of said recess means in said templet and second portions of said twisted pair will be untwisted and the wires will be pressed into said pair of coextensive recesses, said controller serving to deflect portions of said twisted pair of wires away from said surface and approximately align said wires with said recess means, and said controller serving to confine said wires in side-by-side relationship with each wire in contact with said pressing member and in contact with said controller during movement of said pressing member over said other portion of said recess means thereby to ensure untwisting of said twisted pair and placement of said wires in said side-by-side recesses.

2. Apparatus as set forth in claim 1, said pressing member comprising a roller.

3. Apparatus as set forth in claim 2, said controller comprising a controller bar extending parallel to said pressing member.

4. Apparatus for deploying a plurality of twisted pairs of wires, locating said pairs in side-by-side co-planar relationship, and untwisting a portion of each pair, said apparatus comprising:

a templet having a wire supporting surface extending thereacross in one direction, a plurality of recess means in said wire supporting surface, each of said recess means having first portions which comprises a single recess which is dimensioned to receive one twisted pair of wires and another portion comprising a pair of side-by-side recesses each of which is dimensioned to receive one wire of one of said twisted pairs, said side-by-side recesses of each recess means extending divergently from said single recess, a wire pressing member which is movable across said surface in said one direction, a wire controller disposed adjacent to said wire pressing member, said controller being in advance of said pressing member relative to the direction of movement of said pressing member across said surface, said controller providing wire deflecting surface portions which extend transversely of said wire supporting surface, actuating means for moving said pressing member and said controller across said wire supporting surface in said one direction, said actuating means having means for maintaining a first spacing between said controller and said pressing member while said pressing member is moving over said first portion of each recess means and for maintaining a second spacing between said pressing member and said controller when said pressing member is moving over said other portion of said recess means, said first spacing being sufficient to provide clearance for said plurality of twisted pairs of wires, said second spacing being substantially equal to the diameter of one wire of one of said twisted pairs whereby, upon locating said plurality of twisted pairs of wires above said surface with said wires extending over said controller and in said one direction and upon pressing said twisted pairs of wires against said surface with said pressing member, said wires will be deployed in said first portions of said recess means, and upon movement of said pressing member and said controller across said surface in said one direction, said twisted pairs will be located in said first portions, and upon movement of said controller relatively towards said pressing member and subsequent movement of said pressing member and said controller along said surface, portions of each of said twisted pairs will be untwisted and the two wires of each twisted pair will be located in said other portions of said recesses.

5. Apparatus as set forth in claim 4, said pressing member comprising a roller.

6. Apparatus as set forth in claim 4, said controller comprising a controller bar extending parallel to said pressing member.

7. Apparatus as set forth in claim 4, said actuating means comprising a slide member, said slide member being movable relative to said templet in said one direction, said controller and said pressing member being carried by said slide member.

8. Apparatus as set forth in claim 7, including static supporting means, said templet being on said static supporting means and said slide member being reciprocably mounted on said static supporting means, said means for maintaining said first and second spacing comprising camming means on said static supporting means and said slide member.

9. Apparatus as set forth in claim 8, wherein said controller is mounted on movable mounting means, said movable mounting means being on, and movable realtive to, said slide member between first and second positions, said controller and said pressing member being at said first spacing when said movable mounting means is in said first position and being at said second spacing when said movable mounting means is in said second position, said camming means being effective to move said movable mounting means from said first positions to said second position.

10. Apparatus as set forth in claim 9, said movable mounting means comprising bell crank means.

* * * * *